United States Patent [19]

Wentzell

[11] Patent Number: 4,588,019

[45] Date of Patent: May 13, 1986

[54] METHODS OF CONTROLLING SOLIDIFICATION OF METAL BATHS

[76] Inventor: Joseph M. Wentzell, Ty Careg, Remsen, N.Y. 13438

[21] Appl. No.: 601,226

[22] Filed: Apr. 17, 1984

[51] Int. Cl.[4] ..... B22D 27/20; C22B 9/18

[52] U.S. Cl. ..... 164/470; 164/57.1; 164/473; 164/497

[58] Field of Search ..... 164/470, 497, 509, 515, 164/55.1, 56.1, 57.1, 97, 473

[56] References Cited

U.S. PATENT DOCUMENTS 3,344,839 10/1967 Sunnen ..... 164/497
3,511,303 5/1970 Parsons ..... 164/470

FOREIGN PATENT DOCUMENTS 16307 2/1979 Japan ..... 164/470
374020 6/1980 U.S.S.R. ..... 164/509

*Primary Examiner*—Francis S. Husar
*Assistant Examiner*—Jerry Kearns
*Attorney, Agent, or Firm*—Buell, Ziesenheim, Beck & Alstadt

[57] ABSTRACT

A method of nucleating highly alloyed metals is provided in which the metal alloy is melted, a metal alloy powder is added to the molten metal under conditions such that the powder enters the metal substantially free of surface impurities and the metal is then cooled to solidification.

9 Claims, 1 Drawing Figure

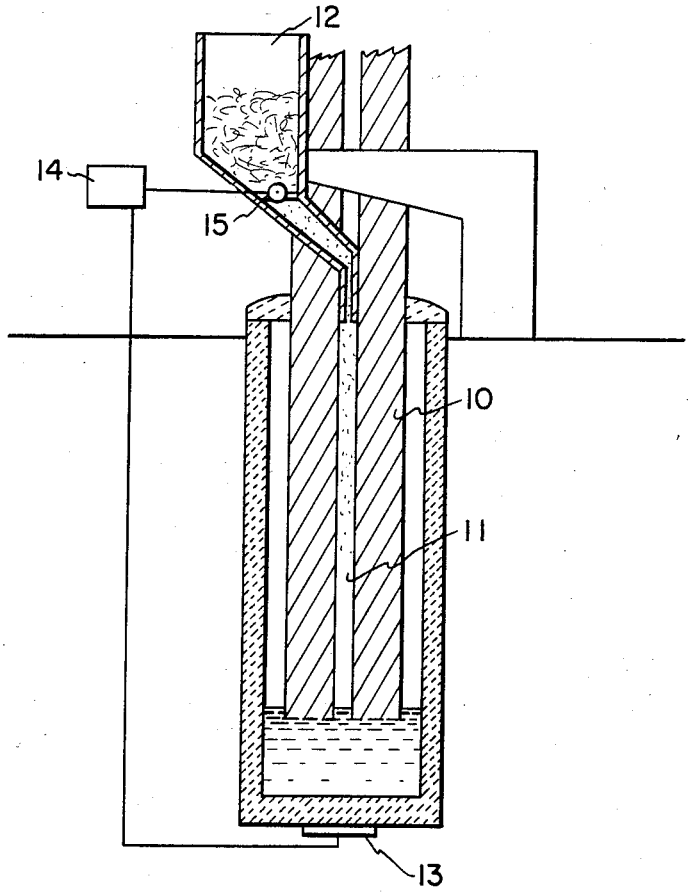
12
14
15
10
11
13

METHODS OF CONTROLLING SOLIDIFICATION OF METAL BATHS

This invention relates to methods of controlling the solidification of metal baths and more particularly to the control of solidification of superalloy baths, e.g., alloys of nickel, cobalt, iron or combinations thereof, which are highly alloyed and having wide liquidus-solidus ranges and poor thermal conductivities. Such superalloys are very susceptible to segregation when cooled from the molten state because of the numerous intermetallic compounds which are subject of formation during cooling and the combination of wide liquidus-solidus ranges and low thermal conductivities which characterize these alloys.

Numerous techniques to facilitate heat extraction and disrupt thermal gradients during vacuum and pressure arc melting have been proposed by me and others. Two of the most common used techniques proposed by me or those disclosed in U.S. Pat. No. 3,353,505 and those commonly known and used in the industry under the term reverse stirring.

The present invention permits a melter of superalloys to cast a very large ingot of superalloy free of gross segregation by continually seeding the molten pool being cast with finely divided metal powder, preferably of the same alloy composition as that being cast. This results in an ingot with controlled nucleation having a fine equiaxed grain structure.

Seeding molten metal with nucleating sites has been previously proposed but attempts to practice the same have failed because the metal powder floats on the molten alloy surface of the bath until it is trapped in the advancing freezing front without ever entering the molten pool in the area where it can effectively control cooling and nucleating of the bath.

I have found that this problem is the result of two effects, the high surface tension of the superalloys and the oxide "patina" on the surface of the superalloy powders, which prevents the metal powder from sinking into the bath. I have found that if one can totally eliminate the oxide patina from the powder surface and control the surface of the molten metal then the particle of metal powder will enter the bath and form an effective nucleating site. I have discovered that, if the metal powder particles are kept very clean and substantially free from surface contamination, and the bath is maintained clean and free of surface contamination, I can quickly solution metal particles in the bath. The smaller the particle, the more rapid the solutioning of the particles. In order to nucleate fine grains and cast a thixotropic bath about 13% by weight of powder is preferred to be added to the molten bath as it is cast or as it is arc melted. Ideally this is accomplished by adding a very clean, fine powder to a clean melt. Unfortunately such ideal conditions, while possible, are not usually found in a commercial melt shop.

I have found, however, that the invention can be practiced in less clean environments by adding the powder in a controlled size fraction through a slag cover on the melt, which slag is capable of wetting the oxide patina on the metal particles. The slag cover should be maintained above the melting temperature of the eutectic oxide formed with the patina but below the melting temperature of the metal particle, bearing in mind the fact that the melting temperature of the particles is lowered as a particle size is reduced. The slag cover should also be chosen to have a relatively high surface tension but low enough to permit the particle to enter the slag, be treated in the slag to remove the oxide patina and be delivered into the superalloy bath. The higher surface tension of the slag will lower the interfacial energy between the slag and molten metal bath thereby allowing an easier entry into the bath of metal particles traveling through the slag in the event the patina has not been fully dissolved. Such slags may be formed of mixtures of calcia, silica and fluorspar. The interfacial energy is approximately equivalent to the mathematical differences in the surface tensions of the two liquids.

BRIEF DESCRIPTION OF THE DRAWING

The single drawing FIGURE illustrates an apparatus for practicing the method of the invention in an ESR furnace.

The method of the invention may be practiced in any of a variety of ways by means of which the nucleating metal powder is added to the metal. If the invention is practiced using a large ESR furnace it may be practiced as illustrated in the accompanying drawing, partly in section of a large ESR furnace arrangement. In this arrangement two or more electrodes 10 may be clustered to form a passage 11 between them into which the powder is metered from a hopper 12. Metering can be accomplished according to melt rate by using a signal from load cell 13 to activate a metering controller 14 which in turn energizes metering device 15 in hopper 12. If the invention is practiced using an open tundish, the powder may be simply broadcast into the tundish through a metering feeder and broadcaster which would ram the powder uniformly down over a small diameter above the teeming nozzle. There are, of course, many other ways in which the powdered metal might be added, all of which are well known in the metallurgical art for adding slag or ferroalloys.

The invention can perhaps best be understood by reference to the following example:

EXAMPLE

A six inch diameter Inco 718 superalloy ingot having a nominal composition of 18.5% Fe, 18.6% Cr, 3.1% Mo, 0.9% Ti, 0.0% Al, 0.2% Mn, 0.3% Si, 0.04% C was cast in an ESR arc furnace under a CaO-Feldspar slag cover. After the arc was struck and a molten pool of metal with an immissable liquid slag cover was established, Inco 718, plus 80 mesh powder which had been exposed to air was metered into the top of the slag cover while maintaining about 24.5 volts and 3000 amperes power. After approximately four inches of ingot build-up, the power was increased 33% and an additional four inches of ingot was deposited; the powder addition was held constant.

On cutting the ingot the grain size was fine and equiaxed in the zone melted at the lower power, and columnar in the zone melted at the higher ampreage. The results indicated that at the lower amperage the powder entered the molten metal pool in the solid or with solidus entrainment, which nucleated the fine grains, whereas at the higher power the powder was fully melted and thereby did not act as nucleating sights.

Cleanliness ratings as determined by remelting samples in an electron beam furnace showed no difference in the ratings between the powder which entered the metal bath in the solidus condition and that which was fully melted indicating the slag cover laundered the powder.

In the foregoing specification I have set out certain preferred practices and embodiments of my invention, however, it will be understood that this invention may be otherwise embodied within the scope of the following claims.

I claim:

1. A method of nucleating highly alloyed metals to control their solidification and reduce segregation by adding a solid particulate metal powder comprising the steps of:

a. melting a metal alloy to form a molten metal alloy bath;

b. providing a molten slag of controlled chemistry over the molten metal alloy bath, through which the metal powder is added to remove surface impurities without complete solution of the powder particles;

c. adding to the surface of the molten slag over the molten metal alloy bath, a solid particulate metal alloy powder of compatible composition under conditions such that the powder particulates pass through said slag and enter the molten metal while still in the solid state substantially free of surface impurities; and d. cooling the metal to solidification.

2. A method as claimed in claim 1 wherein the metal powder is of controlled grain size to provide a desired cooling rate to control segregation and grain size.

3. A method as claimed in claim 1 wherein the slag is controlled to a specific surface tension to facilitate transfer of metal particles from the slag to the molten bath.

4. A method as claimed in any one of claims 1, 2 or 3 wherein the metal powder has the same composition as the molten metal bath.

5. A method as claimed in any one of claims 1, 2 or 3 wherein the molten metal is contained in an arc furnace and the powder added thereto.

6. A method as claimed in claim 4 wherein the molten metal is contained in an arc furnance and the powder added thereto.

7. A method as claimed in any one of claims 1, 2 or 3 wherein the molten metal is cast in continual casting machine and powder added thereto.

8. A method as claimed in claim 6 wherein the molten metal is cast in a continual casting machine and the powder added thereto.

9. A method as claimed in any one of claims 1, 2 or 3 wherein the molten metal is teemed into a static ingot mold and the metal powder added during teeming.

* * * * *